United States Patent [19]

Meckley

[11] Patent Number: 4,640,476

[45] Date of Patent: Feb. 3, 1987

[54] AUTOMATIC ATTITUDE ADJUSTER FOR KITE

[76] Inventor: Charles O. Meckley, 29520 SW. 199th Ave., Homestead, Fla. 33030

[21] Appl. No.: 738,368

[22] Filed: May 28, 1985

[51] Int. Cl.[4] ..... B64C 31/06

[52] U.S. Cl. ..... 244/155 R; 244/155 A

[58] Field of Search ..... 244/153 R, 155 R, 155 A; 446/31, 30, 32; D21/88

[56] References Cited

U.S. PATENT DOCUMENTS

| | | | |
|---|---|---|---|
| 96,550 | 11/1869 | Clark | 244/153 R |
| 434,725 | 8/1890 | Rockwell | 244/153 R |
| 3,599,909 | 8/1971 | Young | 244/153 R |

FOREIGN PATENT DOCUMENTS

| | | | |
|---|---|---|---|
| 382319 | 12/1920 | Fed. Rep. of Germany | 244/153 R |
| 569841 | 6/1945 | United Kingdom | 244/153 R |

*Primary Examiner*—Sherman D. Basinger
*Assistant Examiner*—Rodney Corl
*Attorney, Agent, or Firm*—Kathleen Claffy

[57] ABSTRACT

An automatic attitude adjuster for a kite made from a strip of flexible material having a memory. A preferred material is plastic such as polypropylene. The strip when connected between the kite and the kite bridle changes the position of the tow point and the attitude of the kite automatically in response to variations in wind strength.

5 Claims, 8 Drawing Figures

AUTOMATIC ATTITUDE ADJUSTER FOR KITE

BACKGROUND OF THE INVENTION

The invention is directed to a simple and inexpensive means to automatically change the effective position of the string or bridle attachment on a kite. The word kite as used in this disclosure refers to any airfoil which is lifted by the wind and tethered by a string.

One of the inherent problems with kites is that for the kite to perform well the string or bridle must be attached at a particular point relative to the center of the airfoil surface. The ideal point of attachment varies depending on the wind velocity. Attempts to change the position of the string attachment and thereby alter the attitude of the craft for different wind velocities have been made in the past. The most usual of these adjustments is the provision of a plurality of notches on the string attachment member. However this adjustment must be made manually, requires knowledge of the wind velocity, and is not easily changed to compensate for shifting winds without retrieving the kite.

One prior art patent which controls the attitude of a kite by moving its bridle point is U.S. Pat. No. 4,280,675. This kite is controlled in two discrete steps in response to both release of tension on the cord and the wind. It requires a mechanism using springs and cams and is not completely automatic.

The acrobatic kites can change their attitude in response to motions of the kite handler. The success of these motions depends on the skill of the kite handler.

There still exists a need for a kite attitude adjustment which is dependent on wind strength and is continuous, automatic, and reversible.

SUMMARY OF THE INVENTION

The object of the invention is to provide a superior means for changing the attitude of a kite automatically in response to changes in the wind velocity.

A further object of the invention is to cushion a kite against the shock of a sudden gust of wind.

These objects are achieved by connecting an adjusting member between the kite bridle and the kite.

The word bridle is used throughout the specification and claims in its broadest sense to refer to the cord or arrangement of cords attaching a kite to its line or string. In cases where the bridle is a single cord, the cord is also the kite string or is connected to the kite string in such a way as to make a continuous line from the kite.

Where the bridle has two or more cords, the string is connected to the point where all of the bridle cords are connected together. This point is referred to as the tow point. The tow point on a single bridle kite is the point on the kite to which the bridle, or string, is attached.

Because the invention automatically changes the attitude of the kite by shifting the tow point, the invention is called an Auto Tow.

The adjustment member of the invention is a strip of flexible material having a memory and an attaching means at each end of the strip.

The flexible strip has one end attached to the kite and the other end is attached to the bridle. The end attached to the kite must be firmly attached to the kite in a position which is rearward of the end to be attached to the kite bridle so that when the kite is in flight, the force produced by the wind and the holding force of the kite operator will bend the strip downward which has the effect of moving the tow point both rearward and downward thus changing the attitude of the kite. As the force of the wind increases, the bending of the strip increases; and if the wind velocity decreases, the strip will tend to return to its original position, again changing the attitude of the kite. Because the response is automatic, continuous, and reversible, it can compensate for changes in wind velocity more quickly than can be done by any system which depends on the skill of the kite operator.

DETAILED DESCRIPTION OF THE DRAWINGS

Figure 1:
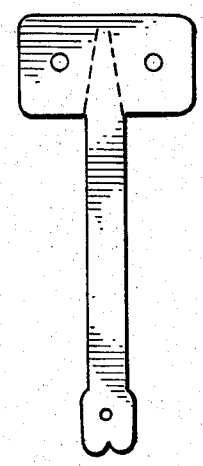
FIGS. 1 thru 4 are different embodiments of the adjustment member.

The attitude adjuster shown in FIGS. 1 thru 4 is a strip of flexible material which has a memory such as plastic, rubber, fiberglass, etc. The length and thickness of the strip is chosen to suit the type of size of kite. The exact dimensions are not critical. Good results have been obtained using a six inch strip of ⅛ inch polypropylene on a keel kite with a 35 inch wingspread.

FIGS. 1 thru 4 show some examples of the shapes which the strip may have. The shape of the upper end of the strip, as shown in the drawings, and the type of attachment used can vary with the type of kite. Any known attachment means can be used if it provides a firm attachment to the kite assembly.

The firm attachment should be such that when the kite is in flight, the adjustment member will bend in response to force but will not pivot around a single point of attachment. The attachment can be made either to a rigid portion of the kite, such as a stiffening member, or to a portion of the kite which maintains its position relative to other parts of the kite when the kite is flown. If the kite is symmetrical about a fore-to-aft center line, the center line of the kite should be in the same plane as the center line of the flexible strip. In the case of a box kite, the center line of the strip should be in the same plane as the support member to which it is attached. The hole at the lower end of the strips in FIGS. 1 thru 4 is used for attaching to the bridle.

Figure 5:
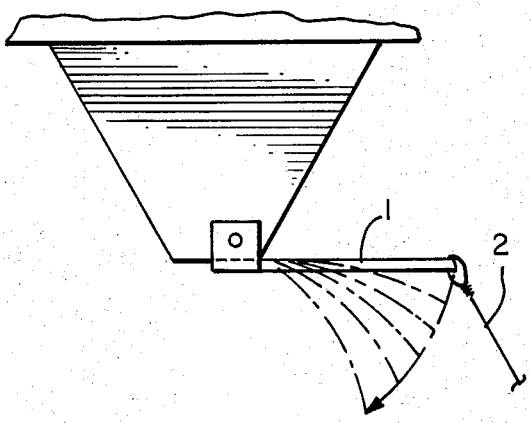
FIG. 5 shows the invention attached to a keel kite with a showing of the positions the member can take.
Figure 7:
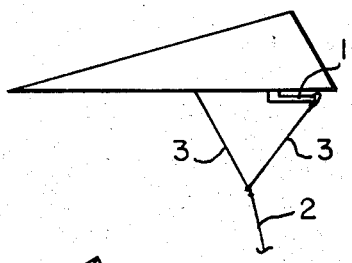
FIG. 7 shows the attachment of the invention to a diamond kite with a two cord bridle.
Figure 6:
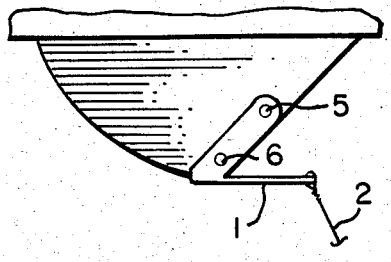
FIG. 6 shows the attachment of the embodiment of FIG. 4 to a keel kite.

FIG. 1 shows an embodiment of the invention which has been used with a Styrofoam keel kite. The dotted lines in FIG. 1 represent fold lines. The strip is folded along these lines and then attached to the keel of the kite by a rivet which passes through the keel and the two holes. This is shown attached in FIG. 5. The size of the strip and the keel are not shown to scale. In operation, as the wind increases, the strip bends downward assuming positions as shown by the dotted lines in FIG. 5. The bending is a smooth transition and is reversed any time that the wind velocity lessens. This immediate and smooth response also prevents the kite from getting out of control in gusty winds.

The attaching point of the invention can be slightly rearward of the point where the bridle would be attached without the invention because the bridle itself is connected farther forward because of the extension of the flexible strip.

Figure 2:
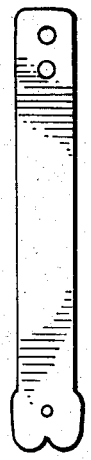
Figure 8:
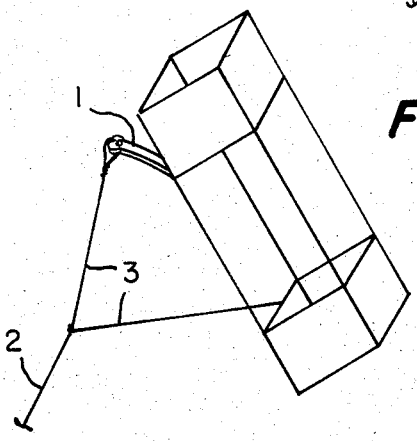
FIG. 8 shows the invention attached to a box kite with a two cord bridle.

The embodiment of FIG. 2 can be attached to a stiffening member by stapling, clamping, or other means. This embodiment could be used with the box kite of FIG. 8.

In each of FIGS. 5 thru 8, the numeral 1 refers to the strip of the invention, 2 is the tow point and 3 is the bridle.

Figure 3:
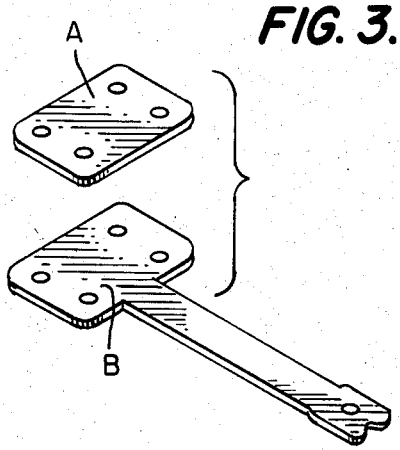

FIGS. 3, A and B show mating members, B is the flexible strip and A is a fastening member. The circles in the flexible strip represent snap members and the circles in A represent mating snap members. These can be snaps of the type used as garment fasteners. The strip of B is placed in the desired position under a kite airfoil made of fabric such as nylon and the mating member A is placed over the airfoil and snapped to the strip with the fabric of the kite held between the two mating parts in a firm attachment. This type of attachment can be used with the diamond kite shown in FIG. 7. The kite in FIG. 7 uses a two cord bridle 3,3. The kite string is attached at tow point 2. When the flexible strip 1 is bent downward, the tow point 2 assumes a new position which is both downward and rearward of its initial position.

When attaching the flexible strip to a kite with more than one cord to its bridle, the strip is attached at, or near, the point at which the most forward of the bridle lines is normally attached.

Figure 4:
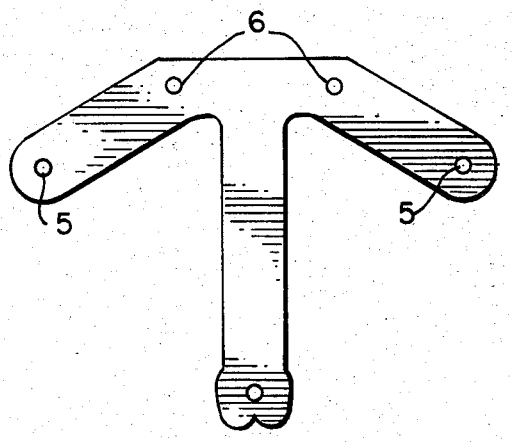

The embodiment of FIG. 4 was made from a plastic strip with integral attachment wings 5. The strip was bent at the fold lines and attached to a light weight plastic keel of a kite which is on the market. The stiffness of the wings 5 and the tautness of the keel in flight made a firm attachment through rivets 5—5 and 6—6.

The flexible strip of the invention can either be attached to existing kites or built into kites as they are being made. Modifications of a kite to accommodate the invention such as adding a stiffener to be used as an attaching point can be made if desired, but are usually not necessary.

The forms of the invention described are illustrative. Modifications may be made without departing from the spirit of the invention.

I claim:

1. An automatic adjuster for a kite comprising a strip of flexibly bendable material which has a memory, said strip having a first end which is adapted to be firmly connected to a portion of a kite assembly, said portion being rigid when the kite is in flight, and said strip having a second end adapted to be connected to a kite bridle so that when the strip is connected and a force is applied between the bridle and said strip said strip bends in response to the applied force.

2. An improved kite assembly having an airfoil with a forward edge and an attachment point for a kite bridle, the improvement comprising:

a. a strip of bendably flexible material having a memory, with one end of said strip being firmly attached to said attachment point and the other end of said strip adapted to the attached to the kite bridle;

b. said strip being attached so that said one end is rearward of said other end in relation to the forward edge of the airfoil, whereby the attitude of the airfoil in flight will be automatically changed in a continuous and reversible manner by bending of said strip caused by the force produced by the wind as opposed to the holding force of the kite operator.

3. The kite assembly of claim 2 wherein the bridle is a single cord.

4. The kite assembly of claim 2 wherein the bridle is an arrangement of cords and said strip is firmly attached to the foremost bridle attachment point and said other end of said strip is attached to the bridle cord which is designed to be the foremost of the plurality of cords in the bridle.

5. A kite assembly comprising a keel kite having a wing and a keel and a strip of flexible material having a memory, said strip having a first end attached to the keel of the kite and having a second end adapted to be connected to a kite string with said first end being attached to the keel in a position so that the strip, in an unstressed condition, is at an angle away from a line perpendicular to the wing surface of the kite, and when in a stressed condition, as produced by the wind's lifting the kite in opposition to a holding force on the string when the kite is flown, the strip bends and the second end of the strip moves farther away from the wing and towards a line perpendicular to the wing thereby changing the attitude of the kite automatically in response to variations in wind strength.

* * * * *